US005195752A

United States Patent [19]

Reeves et al.

[11] Patent Number: 5,195,752

[45] Date of Patent: Mar. 23, 1993

[54] PAINT BALL SENSOR VEST

[76] Inventors: Gary L. Reeves, 575 Hillcrest - Apt. 7; John Ellis, 2800 Chavez Dr., both of Reno, Nev. 89502

[21] Appl. No.: 779,904

[22] Filed: Oct. 21, 1991

[51] Int. Cl.[5] ..... A41D 1/04; A63B 71/06; F41J 5/04

[52] U.S. Cl. ..... 273/374; 2/102; 273/454

[58] Field of Search ..... 273/374, 371, 454; 124/72, 73, 74, 76; 2/102

[56] References Cited

U.S. PATENT DOCUMENTS

| | | | |
|---|---|---|---|
| 3,788,298 | 1/1974 | Hale | 124/74 X |
| 4,531,503 | 7/1985 | Shepherd | 124/76 |
| 4,761,005 | 8/1988 | French et al. | 273/454 |
| 4,819,609 | 4/1989 | Tippmann | 124/72 |
| 4,824,107 | 4/1989 | French | 273/454 |
| 4,936,282 | 6/1990 | Dobbins et al. | 124/74 |

*Primary Examiner*—William H. Grieb
*Attorney, Agent, or Firm*—Richard C. Litman

[57] ABSTRACT

Disclosed is an impact-responsive vest having a piezoelectric layer sandwiched between other layers and connected by wire leads to a control module. The control module includes a programmable read-only memory having parameters identifying, through the amplitude of a signal impact, forces produced by paint ball impacts which are compared with impact signals from the vest. When a match is found, the compare circuit sends a signal to an audible alarm to alert the wearer that he or she has beenhit by a paint ball. The control module is compact and is worn by the vest-user. Also disclosed is a remote reset module to provide a reset signal to the control module once the alarm has been activated.

5 Claims, 3 Drawing Sheets

PAINT BALL SENSOR VEST

FIELD OF THE INVENTION

This invention relates to a paint ball sensor vest incorporating a piezoelectric transducer responsive to the impact of a paint ball on the vest, a micro controller including a compare circuit, and an audio alarm circuit to alert the wearer that he or she in fact has been hit by a paint ball.

BACKGROUND OF THE INVENTION

The use of marking guns is well known. In the past, marking guns have commonly been used by veterinarians or wildlife management personnel to mark animals as a means of counting the wild animals, herding the wild animals, or other similar desired procedures. Another example of the use of marking guns is the marking of trees in forestry projects.

Marking guns commonly use compressed gas pressure to fire a hollow projectile generally configured as a sphere, or ball constructed of a thin wall formed of plastic or gelatin which will break upon impact with a target. Contained inside the sphere is a colored liquid such as paint.

More recently, marking guns have been used in mock "war games" or survival games. Groups or teams are formed to compete with each other as though in a "war", usually within a limited geographical area such as a woods. When members of opposing groups or teams come upon each other they use the marking guns to try to score a hit by marking the opposing member or members with the paint balls impacting on their clothing. If a member is "hit" as signified by a paint spot, that member is eliminated from the game. The group or team that has the last surviving member wins the game.

PRIOR ART

Representative examples of marking guns used to fire "paint balls" in war or survival games are found in U.S. Pat. No. 3,788,298 issued to James C. Hale on Jan. 29, 1974, U.S. Pat. No. 4,531,503 issued to Robert Shepherd on Jul. 30, 1985, U.S. Pat. No. 4,819,609 issued to Dennis J. Tippmann on Apr. 11, 1989, and U.S. Pat. No. 4,936,282 issued to Jerrold M. Dobbins and Ross Alexander on Jun. 26, 1990.

Because of the excitement of the war or survival games, a group or team member may not realize that he or she has been hit by a paint ball, particularly if the impact was on the back or side of the body out of the normal range of viewing by the member. Alternatively, the impact of the paint ball may be lighter than normal, depending on the distance between the member and the marking gun. Also, the impact of the paint ball, may be confused with other types of impacts such as from tree limbs, etc. Accordingly, there is a need for an impact sensor capable of distinguishing between paint ball impacts and other impacts, and of providing an alarm to warn the member that he or she has been hit.

Impact sensors are known in the prior art. U.S. Pat. No. 4,824,107 issued to Barry J. French discloses a vest having a piezoelectric transducer incorporated therein to provide a signal indicating an impact suffered by the wearer in such games as martial arts or fencing. The vest incorporates a piezoelectric film, polyvinylidene fluoride (PVDF) sandwiched between thin metalized layers of electrically conductive metal. The signal produced by the impact on the vest is transmitted to a remote receiver which totalizes the number of impacts and which provides a signal corresponding to the number of impacts felt. The vest disclosed by French is not capable of distinguishing between different types of impacts, and French does not incorporate an alarm system within or near the vest.

SUMMARY AND OBJECTS OF THE INVENTION

It is an object of the invention to provide a paint ball sensor vest capable of distinguishing between paint ball impacts and other impacts.

It is another object of the invention to provide a paint ball sensor vest with an audible alarm means to alert the wearer of the vest that he or she has been hit by a paint ball.

It is another object of the invention to provide a paint ball sensor vest which incorporates a piezoelectric transducer connected to a compact, self-contained micro controller including an analog to the digital converter circuit, a compare circuit, a programmable memory, and an audible alarm circuit, all carried by the user of the vest.

It is still another object of the invention to provide a lightweight paint ball sensor vest formed of multiple layers including a piezoelectric transducer connected to a control module which may be battery-operated and which may be reset by a remote battery-operated reset module.

Other objects, features and advantages of this invention will be apparent from the following detailed description and the appended claims, reference being had to the accompanying drawings forming a part of the specification, wherein the reference numbers designate corresponding parts of the several views.

DETAILED DESCRIPTION OF PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology and terminology employed herein is for the purpose of description and not limitation.

Figure 1:
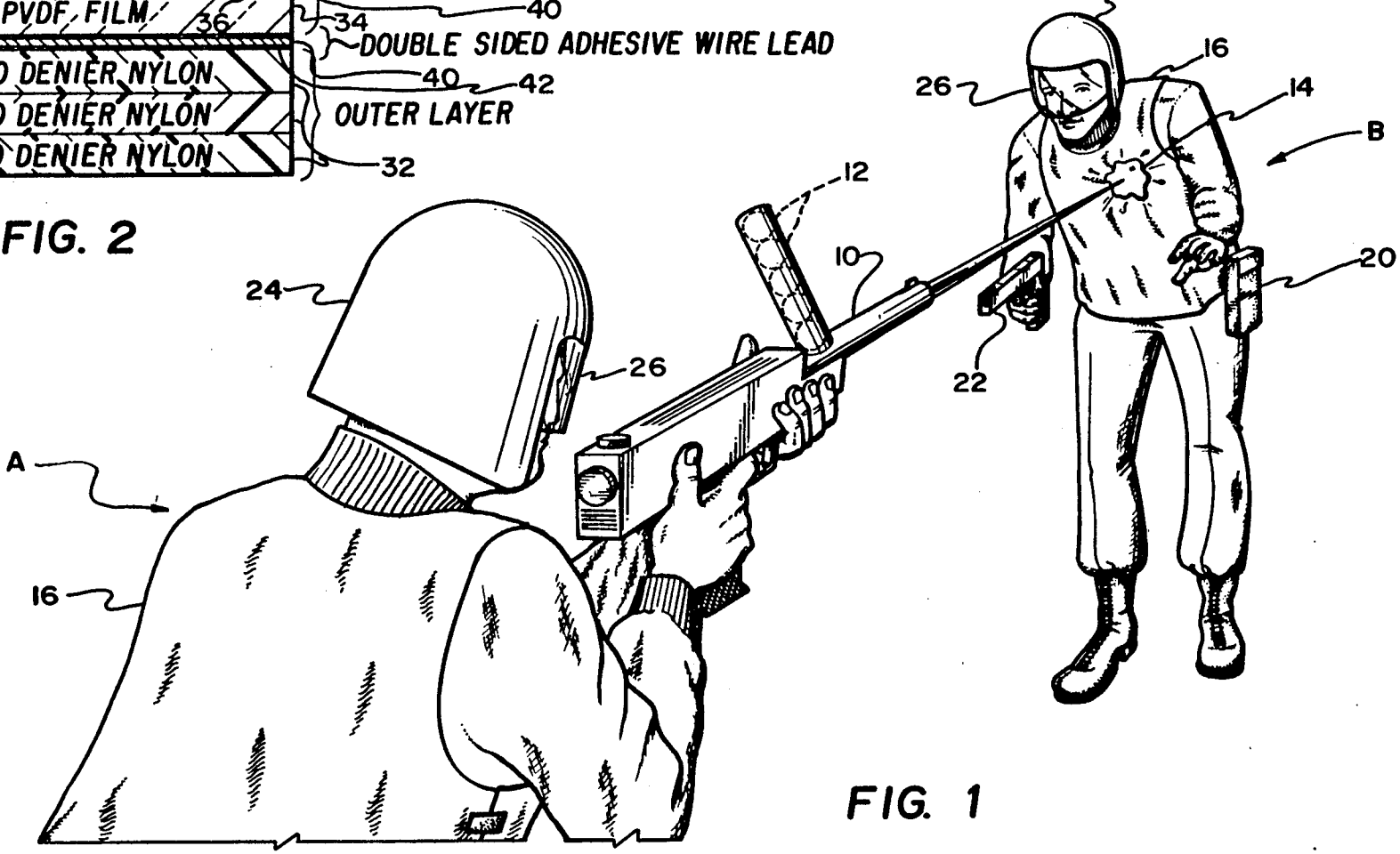
FIG. 1 shows two members of opposing teams wearing the inventive vest during a mock war or survival game.
Figure 4:
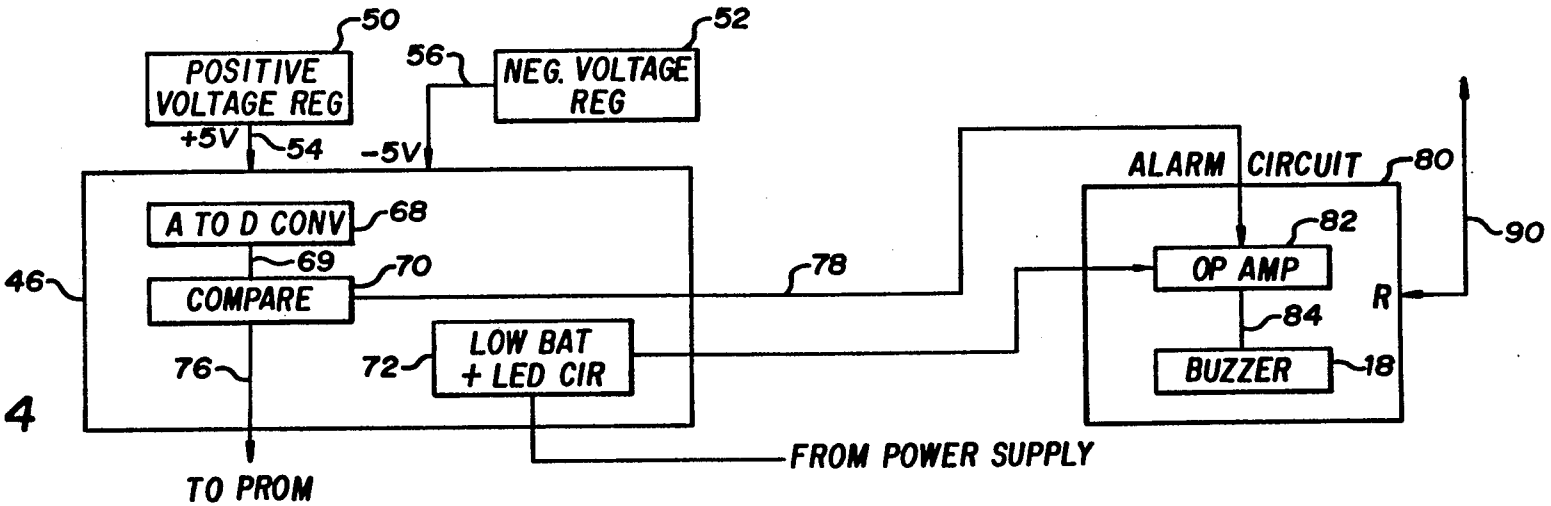
FIG. 4 shows the structure of the micro controller circuit and of the alarm circuit of FIG. 3.

In FIG. 1 there is shown two opposing members, A and B, of teams or groups engaged in a "war" or "survival" game. Each of the members is equipped With a conventional marking gun capable of firing conventional "paint balls". Member A, for example, is equipped with a rifle-type marking gun 10 loaded with paint balls 12, one such paint ball having just been fired at member B as evidenced by the paint spot 14 appearing on sensor vest 16 worn by member B. Because member B has suffered a "hit", a piezoelectric buzzer 18 (see FIG. 4) contained in control module 20 will alert member B and others around him that he is eliminated from the game. Control module 20 may be carried in any convenient fashion by the participating members. Member B is equipped with a pistol-type marking gun 22. Member B is also wearing a sensor vest 16 connected to a similar control module (not shown), and both members A and B are wearing protective helmets 24 with transparent visors 26 to avoid inadvertent injury to the head.

In the "heat of the battle" a member might not realize that he or she has been hit by a paint ball, particularly since the impact is not designed to be hard enough to be injurious. Also, because the games are played normally in the woods, it may be difficult for a team or group member to distinguish between a paint ball impact and other types of impacts from, for example, tree branches a participant might mistakenly think he has suffered a hit when in fact he did not, and vice versa. The inventive sensor vest 16 coupled with the control module 20 distinguishes between paint ball and other impacts and sounds an alarm when the control module 20 determines that the impact is in fact that of a paint ball.

Figure 2:
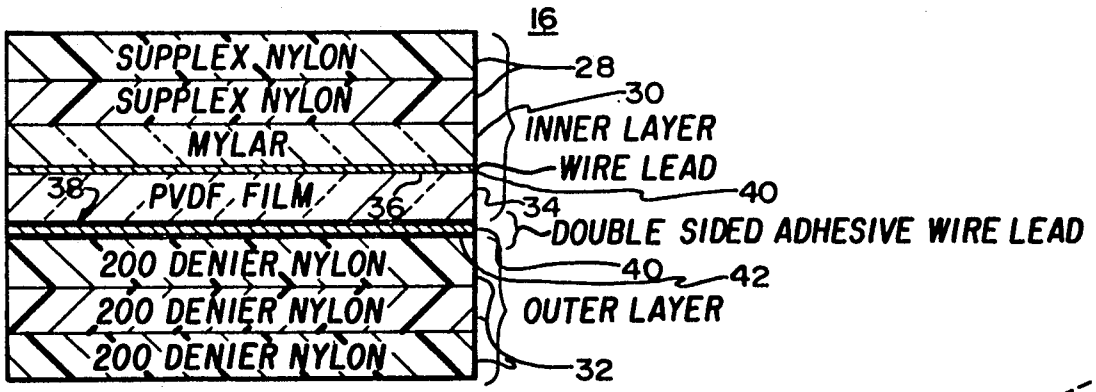
FIG. 2 is a cross section showing the several layers of material forming the inventive vest.

FIG. 2 is a cross section showing the several layers of material which make up sensor vest 16. The inner liner is formed of two layers of Supplex nylon 28 followed by a layer of Mylar 30. The outer liner is formed of three layers of 200 denier nylon 32, for example, Cordura nylon. Sandwiched between the inner and outer liners or layers is a layer of piezoelectric film 34, polyvinylidene fluoride (PVDF) coated with thin metalized layers 36,38 connected to suitable electrical leads 40 held in place, for example, by means of a double-sided adhesive 42. The overall thickness of the several layers of sensor vest 16 is approximately 21 mil.

Figure 3:
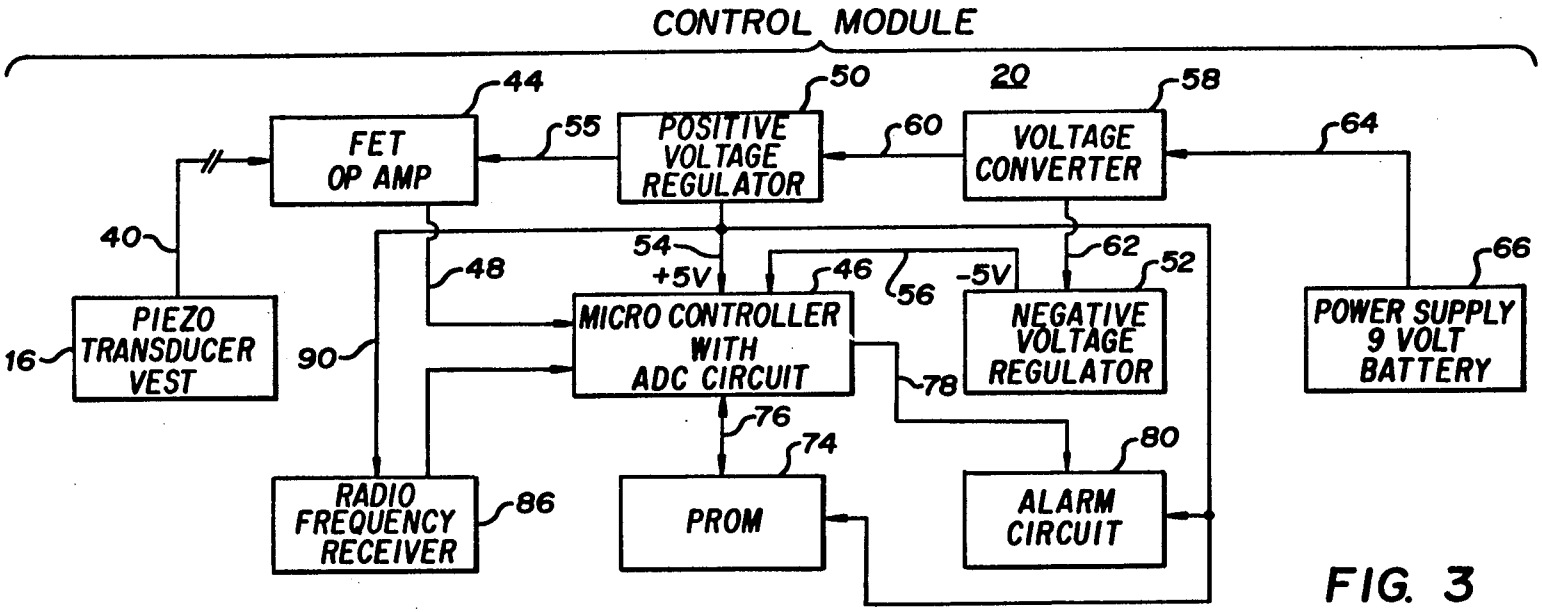
FIG. 3 shows the circuit arrangement for the control module.

The circuit arrangement in the control module 20 connected to sensor vest 16 is shown in FIG. 3. Deformation of the piezoelectric film 34 caused by an impact to the sensor vest 16 produces an electric signal which varies in amplitude depending on the force of the impact. The impact signal is carried over leads 40 to an operational amplifier 44 which in turn feeds the impact signal to micro controller 46 over wire 48. Micro controller 46 receives a +5 volt input from positive voltage regulator 50 and a −5 volt input from negative voltage regulator 52 over wires 54 and 56, respectively. Operational amplifier 44 also receives a positive voltage input from positive voltage regulator 50 over wire 55. Positive voltage regulator 50 and negative voltage regulator 52 are connected to voltage converter 58 through wires 60 and 62, respectively. The voltage converter in turn is connected by wire 64 to a 9 volt battery power supply 66 which supplies power to the control module 20.

Within micro controller 46 (see FIG. 4) there is an analog to digital converter circuit 68, a compare circuit 70, and a low battery and LED circuit 72. The analog to digital converter circuit 68 changes the impact signal from sensor vest 16 from an analog signal to a digital signal which is sent over wire 69 to compare circuit 70. Compare circuit 70 is also connected to a programmable read-only memory (PROM) circuit 74 by wire 76. Contained within PROM 74 are the parameters defining the limits of the amplitude of a digital signal created by a paint ball impact. These parameters are compared with the signal received from sensor vest 16 in compare circuit 70 and, when a match is found, a signal is sent over wire 78 to alarm circuit 80 and through an operational amplifier 82 to an audio alarm or buzzer 18 over wire 84.

The low battery and LED circuit 72 in micro controller 46 receives a signal from power supply 66 and provides a signal to alarm circuit 80 when the battery is low and should be replaced.

Also included in the control module 20 is a radio frequency receiver 86, the purpose of which is to receive a reset signal from a remote reset module 88. The reset signal is sent over wire 90 to reset alarm circuit 80 and micro controller 46.

Figure 5:
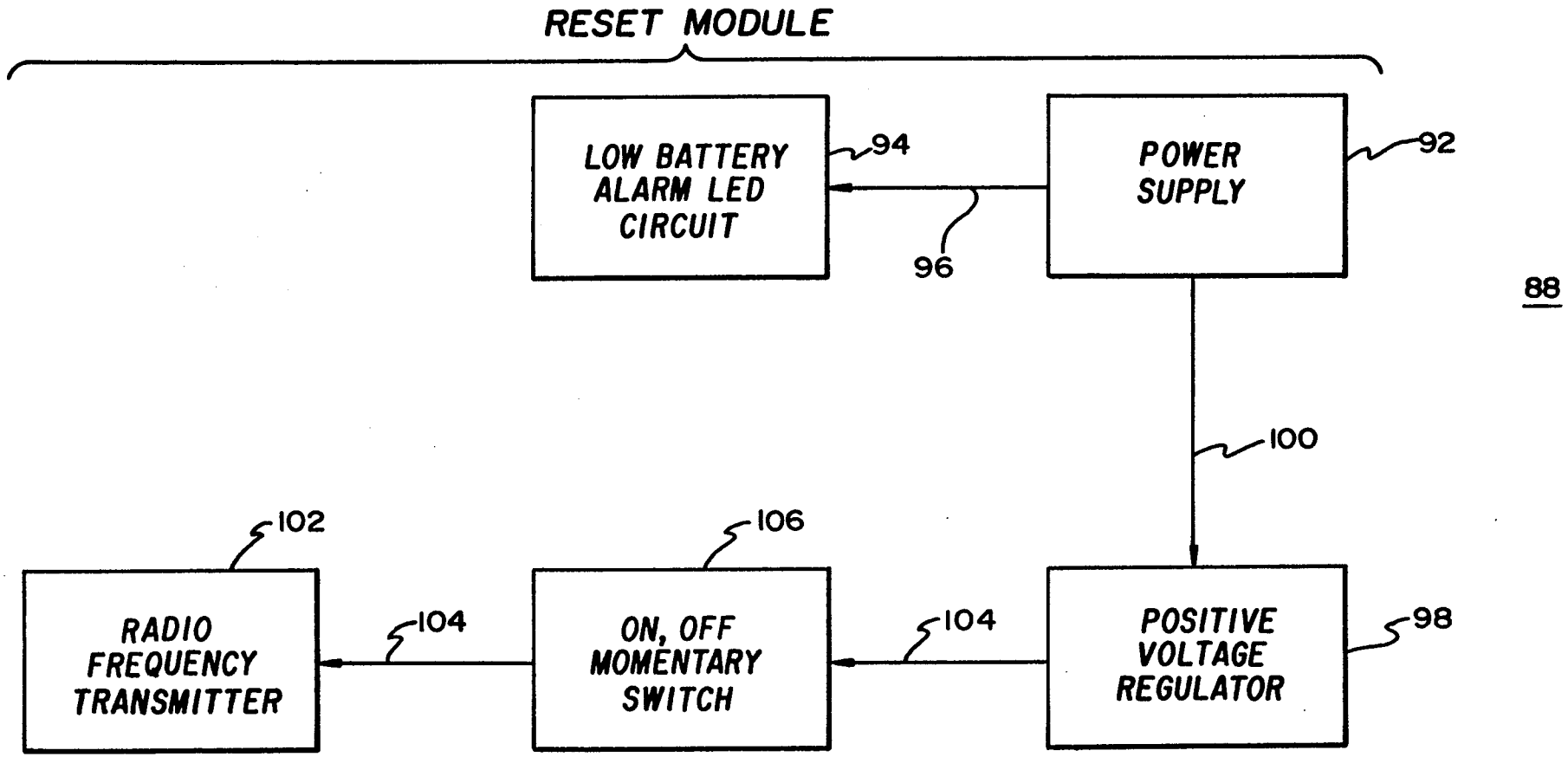
FIG. 5 shows the remote reset module.

Reset module 88, shown in FIG. 5, includes a 9 volt battery power supply 92 connected to a low batter alarm LED circuit 94 by wire 96 and to a positive voltage regulator 98 by a wire 100. Regulator 98 is connected to radio frequency transmitter 102 by wire 104 through an ON/Of momentary switch 106. When it is desired to reset control module 20, switch 106 is actuated to send a reset signal from transmitter 102 to receiver 86 which in turn distributes the signal through wire 90 to micro controller 46, alarm circuit 80, and PROM 74. Reset module 88 is designed to operate up to a distance of six feet from control module 20.

As can be seen from the above description, sensor vest 16 is responsive to impact forces and, through the deformation of the piezoelectric film 34, sends an impact signal to control module 20 which compares the amplitude of the impact signal with preprogrammed amplitudes of paint ball impact signals. When a match is found, a signal is sent to an audible alarm in the form of a buzzer 18 which alerts the vest wearer that he or she has been hit by a paint ball. The control module 20 is reset by a reset module 88 which may be operated, for example, by a referee of the "war" or "survival" game.

While it will be apparent that the preferred embodiment of the invention herein disclosed is well calculated to fulfill the objects above stated, it will be appreciated that the invention is susceptible to modification, variation and change without departing from the proper scope or fair meaning of the subjoined claims.

We claim:

1. A paint ball sensor vest comprising:

a vest means including a piezoelectric film means effective to provide a signal in response to an impact force;

a compact control module means connected to said vest means, said control module means being programmed to differentiate paint ball impacts from other impacts, and including alarm means to alert the wearer of the vest means of impacts by paint balls;

amplifier means connected to said piezoelectric film means by wire leads;

a micro controller means connected to said amplifier means, said micro controller means including an analog to digital converter means and a compare circuit means;

a programmable read-only memory means connected to said micro controller means, said memory means including parameters in terms of signal amplitude of paint ball impacts; and audible alarm means responsive to a signal from said compare means in said micro controller means to produce an audible alarm when there is no match between the signal produced by the piezoelectric film means; whereby the wearer of the vest means is audibly alerted of a paint ball impact.

2. A paint ball sensor vest as in claim 1, said control module means further comprising:

a radio frequency receiver means;

a battery-operated power supply means;

a voltage converter means connected to said battery-operated power supply means;

a negative voltage regulator means connected between said voltage converter means and said micro controller means;

a positive voltage regulator means connected between said voltage converter means and said micro controller means, said amplifier means, said alarm means, said programmable read-only memory means, and said radio frequency receiver means; and a low battery and LED circuit means connected to said alarm means;

said alarm means comprising a second amplifier means and a buzzer means;

said radio frequency receiver means being responsive to a remote reset module means to reset said control module means after activation of said alarm means.

3. A paint ball sensor vest as in claim 2, said remote reset module means comprising:

a second battery-operated power supply means connected to a low battery alarm LED circuit means and to a second positive voltage regulator means;

an ON/Off momentary switch means connected to said second positive voltage regulator means; and a radio frequency transmitter means connected to said ON/OFF momentary switch means; whereby a reset signal can be sent from said radio frequency transmitter means to said radio frequency receiver means by closing said ON/OFF momentary switch means.

4. A control module means for a paint ball sensor vest comprising:

an amplifier means connected to said vest by wire leads to receive impact signals from said vest;

a micro controller means connected to said amplifier means to receive impact signals from said amplifier means;

said micro controller means including an analog to digital converter circuit means, a compare circuit means, and a low battery and LED circuit means;

a programmable read-only memory means connected to said micro controller means to provide signals having an amplitude range corresponding to impacts from paint balls;

said compare circuit means comparing the amplitude of the impact signals from said vest with said amplitude range signals from said memory;

a battery-operated power supply means to supply power to the several components of said control module means;

an audio alarm circuit means connected to said micro controller means for receiving a signal from said compare circuit means and from said low battery and LED circuit means; and a radio frequency receiver means for receiving reset signals from a remote reset module means; whereby the control module means can identify and distinguish paint ball impacts from other impacts and thereby activate the alarm means only in response to paint ball impacts.

5. A control module means as in claim 4, further comprising:

a reset module means which includes a second battery-operated power supply means, a second low battery alarm LED circuit means connected to said second power supply means, a second positive voltage regulator means connected to said second power supply means, an ON/OFF momentary switch means connected to said second positive voltage regulator means, and a radio frequency transmitter means connected to said ON/OFF momentary switch means; whereby a reset signal can be sent from said reset module means to said control module means by momentarily activating said switch means.

* * * * *